US012116800B2

(12) United States Patent
Studebaker, Jr.

(10) Patent No.: US 12,116,800 B2
(45) Date of Patent: Oct. 15, 2024

(54) APPARATUS, SYSTEM AND METHOD FOR A PORTABLE CORRAL PANEL

(71) Applicant: Robert L. Studebaker, Jr., Tulsa, OK (US)

(72) Inventor: Robert L. Studebaker, Jr., Tulsa, OK (US)

( * ) Notice: Subject to any disclaimer, the term of this patent is extended or adjusted under 35 U.S.C. 154(b) by 0 days.

(21) Appl. No.: 18/502,346

(22) Filed: Nov. 6, 2023

(65) Prior Publication Data

US 2024/0068270 A1 Feb. 29, 2024

Related U.S. Application Data

(63) Continuation of application No. 17/151,328, filed on Jan. 18, 2021, now Pat. No. 11,846,114.

(60) Provisional application No. 62/993,558, filed on Mar. 23, 2020, provisional application No. 62/937,215, filed on Nov. 18, 2019.

(51) Int. Cl.

| | |
|---|---|
| ***E04H 17/18*** | (2006.01) |
| ***A01K 3/00*** | (2006.01) |
| ***E04H 17/00*** | (2006.01) |
| ***E04H 17/14*** | (2006.01) |

(52) U.S. Cl.

CPC ..... *E04H 17/18* (2013.01); *E04H 17/009* (2021.01); *E04H 17/013* (2021.01); *E04H 17/1486* (2021.01)

(58) Field of Classification Search

CPC ... E04H 17/013; E04H 17/18; E04H 17/1486; E01H 17/009; A01K 1/0017; A01K 1/0005; A01K 1/0035; A01K 3/001

See application file for complete search history.

(56) References Cited

U.S. PATENT DOCUMENTS

| | | | | |
|---|---|---|---|---|
| 7,958,616 | B2 * | 6/2011 | Meyer, Jr. | A01K 3/001 119/514 |
| 8,465,063 | B1 * | 6/2013 | Jones | E05B 65/0007 292/264 |
| 10,132,101 | B1 * | 11/2018 | Hongthong | E04H 17/18 |
| 2006/0065209 | A1 * | 3/2006 | May | A01K 1/0017 119/502 |

(Continued)

FOREIGN PATENT DOCUMENTS

| | | | |
|---|---|---|---|
| FR | 2503227 | A1 * | 10/1982 |
| FR | 2543416 | A1 * | 10/1984 |

(Continued)

*Primary Examiner* — Kristen C Hayes

(74) *Attorney, Agent, or Firm* — Frederic Dorwart, Lawyers PLLC; Penina Michlin

(57) ABSTRACT

An apparatus, system and method for a portable corral panel. A portable livestock corral fence system includes a gate panel and fence panels, each fence panel including a bottom rail, a lock tab and a leg socket coupled to the bottom horizontal rail, and a foldable base including a peg mateable to the leg socket, a foot coupled to the peg, and a chain, the peg mateable to the leg socket in two distinct positions: a standing position, wherein the foot extends perpendicularly to the bottom rail in the standing position, and a stacking position, wherein the foot folds flat into the stacking position such that the foot is parallel to the bottom horizontal rail, and wherein the chain wraps around the bottom rail and engages the lock tab to lock the foldable base into either one of the two distinct positions.

20 Claims, 10 Drawing Sheets

(56) References Cited

U.S. PATENT DOCUMENTS

2010/0207088 A1* 8/2010 Bowman ..... E04H 12/2238
256/31

FOREIGN PATENT DOCUMENTS

| | | | | | |
|---|---|---|---|---|---|
| GB | 945211 | A | * | 12/1963 | |
| GB | 2548124 | A | * | 9/2017 | ..... E01F 13/02 |
| WO | WO-2021159171 | A1 | * | 8/2021 | ..... A01K 1/0017 |

* cited by examiner

APPARATUS, SYSTEM AND METHOD FOR A PORTABLE CORRAL PANEL

CROSS REFERENCE TO RELATED APPLICATIONS

This application is a continuation of co-pending U.S. application Ser. No. 17/151,328 to Studebaker, filed Jan. 18, 2021 and entitled "APPARATUS, SYSTEM AND METHOD FOR A PORTABLE CORRAL PANEL" which claims the benefit of U.S. Provisional Application No. 62/937,215 to Studebaker, filed Nov. 18, 2019 and entitled "APPARATUS, SYSTEM AND METHOD FOR A PORTABLE CORRAL PANEL," and also claims the benefit of U.S. Provisional Application No. 62/993,558 to Studebaker, filed Mar. 23, 2020 and entitled "APPARATUS, SYSTEM AND METHOD FOR A PORTABLE CORRAL PANEL," each of which is hereby incorporated by reference for all purposes, except to the extent that the incorporated material is inconsistent with the express disclosure herein, in which case the language in this disclosure controls.

BACKGROUND OF THE INVENTION

1. Field of the Invention

Embodiments of the invention described herein pertain to the field of livestock enclosures. More particularly, but not by way of limitation, one or more embodiments of the invention enables an apparatus, system and method for a portable corral panel.

2. Description of the Related Art

Livestock such as cattle, horses and sheep often need to be confined within fenced enclosures called corrals. Typical enclosures include gated corrals, which may include structures such as holding pens, paddocks, alleyways, or squeeze chutes. Due to the large area of many livestock facilities, the search for green pastures, and the frequent movement of livestock, livestock handling equipment, such as a corral, sometimes needs to be moved from place to place. Additionally, sorting animals and other procedures sometimes must occur in fields or pastures that are distant or remote from permanent corrals. However, constructing permanent animal containment facilities or enclosures in distant or remote locations is prohibitively time consuming and expensive.

Conventionally, livestock enclosures are constructed of several individual freestanding fence panels that may be arranged together, sometimes with a gate, to form a temporary corral or other enclosure type of a desired size and shape at a selected location away from permanent enclosures. Conventional portable fence panels are made of steel or other similar rugged and heavy materials that can handle being pushed, butted, or leaned on by the livestock. The fence panels are freestanding because each panel has legs to help provide support when pushed by livestock. Despite this, some conventional fence panels cannot withstand harsh treatment by the livestock, particularly if the land at the selected location is uneven.

Unfortunately, these conventional fence panels are also difficult to transport from place to place because the panels do not stack in an efficient manner, and due to their design may get unintentionally tangled during transport. For example, freestanding fence panel legs may prevent a panel from lying flat or prevent panels from efficiently stacking on top on another because the long legs extend perpendicularly to the fence panel. Further, transporting these conventional portable fence panels can be difficult because many fence panels are needed to form a livestock corral, and the fence panels are heavy and awkward to maneuver due to the strange shape formed by the fence panel and leg combination. Therefore, conventional portable fence panels require inefficient stacking in the transportation vehicle in a way that takes up excessive space when hauling them from place to place.

As is apparent from the above, conventional portable fence panels suffer from many shortcomings. Therefore, there is a need for an improved apparatus, system and method for a portable corral panel.

BRIEF SUMMARY OF THE INVENTION

One or more embodiments of the invention enable an improved apparatus, system and method for a portable corral panel.

An apparatus, system and method for a portable corral panel is described. Illustrative embodiments of a portable livestock corral fence system includes at least one gate panel, and a plurality of fence panels, each fence panel, including a bottom horizontal rail, a lock tab having a slot coupled to a top side of the bottom horizontal rail, a leg socket coupled to a bottom side of the bottom horizontal rail opposite the lock tab, and a foldable base unit including a peg mateable to the leg socket on a first side of the peg, a foot coupled to the peg on a second side of the peg, and a chain, the peg mateable to the leg socket in two distinct positions: a standing position, wherein the foot extends perpendicularly to the bottom horizontal rail in the standing position and the standing position enabling the fence panel to be freestanding, and a stacking position, wherein the foot folds flat into the stacking position such that the foot is parallel to the bottom horizontal rail in the stacking position, and wherein the chain wraps around the bottom horizontal rail and engages the slot to lock the foldable base into either one of the two distinct positions. In some embodiments, the stacking position further includes a first fence panel of the plurality of fence panels stacked flat above a second fence panel of the plurality of fence panels. In certain embodiments, the chain further includes a link, the link engaging the slot to lock the foldable base unit. In some embodiments, each fence panel further includes a plurality of internal horizontal rails, and a plurality of pairs of vertical straps, each pair of vertical straps of the plurality of pairs of vertical straps welded to and sandwiching the plurality of internal horizontal rails. In some embodiments, the leg socket is a squared tube and the peg nests inside the leg socket when mated in both the standing position and the stacking position. In certain embodiments, the foot is rotated 90 degrees between the standing position and the stacking position. In certain embodiments, the foot is bowed. In some embodiments, each fence panel has exactly two foldable base units that divide such fence panel into thirds.

An illustrative embodiment of a portable livestock corral gate panel includes a rectangular frame including a top horizontal rail, a bottom horizontal rail, a first vertical post on a first end of the bottom horizontal rail and the top horizontal rail, and a second vertical post on a second end of the bottom horizontal rail and the top horizontal rail, a gate hingedly coupled to the second vertical post such that the gate swings around the second vertical post and between the first and second vertical posts, each of the first vertical post and the second vertical post including an outer side opposite the gate, a leg socket coupled to the outer side, and a lock tab having a slot, the lock tab coupled to the outer side above the leg socket, a pair of foldable base units, each foldable base unit of the pair of foldable base units including a peg mateable to one of the leg sockets on a first side of the peg, a foot coupled to the peg on a second side of the peg, and a chain, the peg mateable to the one of the leg sockets in two distinct positions: a standing position, wherein the foot extends perpendicularly to the bottom horizontal rail in the standing position and the standing position enabling the rectangular frame to be freestanding, and a stacking position, wherein the foot folds flat into the stacking position such that the foot is parallel to the bottom horizontal rail in the stacking position, and wherein the chain wraps around the leg socket and engages the slot to lock the pair of foldable base units into either one of the two distinct positions. In some embodiments, the chain is coupled to an outer diameter of the peg by a collar. In certain embodiments, the leg socket is a squared tube, and the stacking position is rotated ninety degrees from the standing position. In some embodiments, the peg nests inside the leg socket when mated in both the standing position and the stacking position. In certain embodiments, a hinge couples the gate to the second vertical post, and further including a second lock tab secured in a corner formed by a top of the hinge and an inside of the second vertical post. In some embodiments, a second chain and the second lock tab are configured to couple a fence panel to the second vertical post. In some embodiments, the chain further includes a link, the link engaging the slot to lock the at least one foldable base. In certain embodiments, the feet are bowed.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
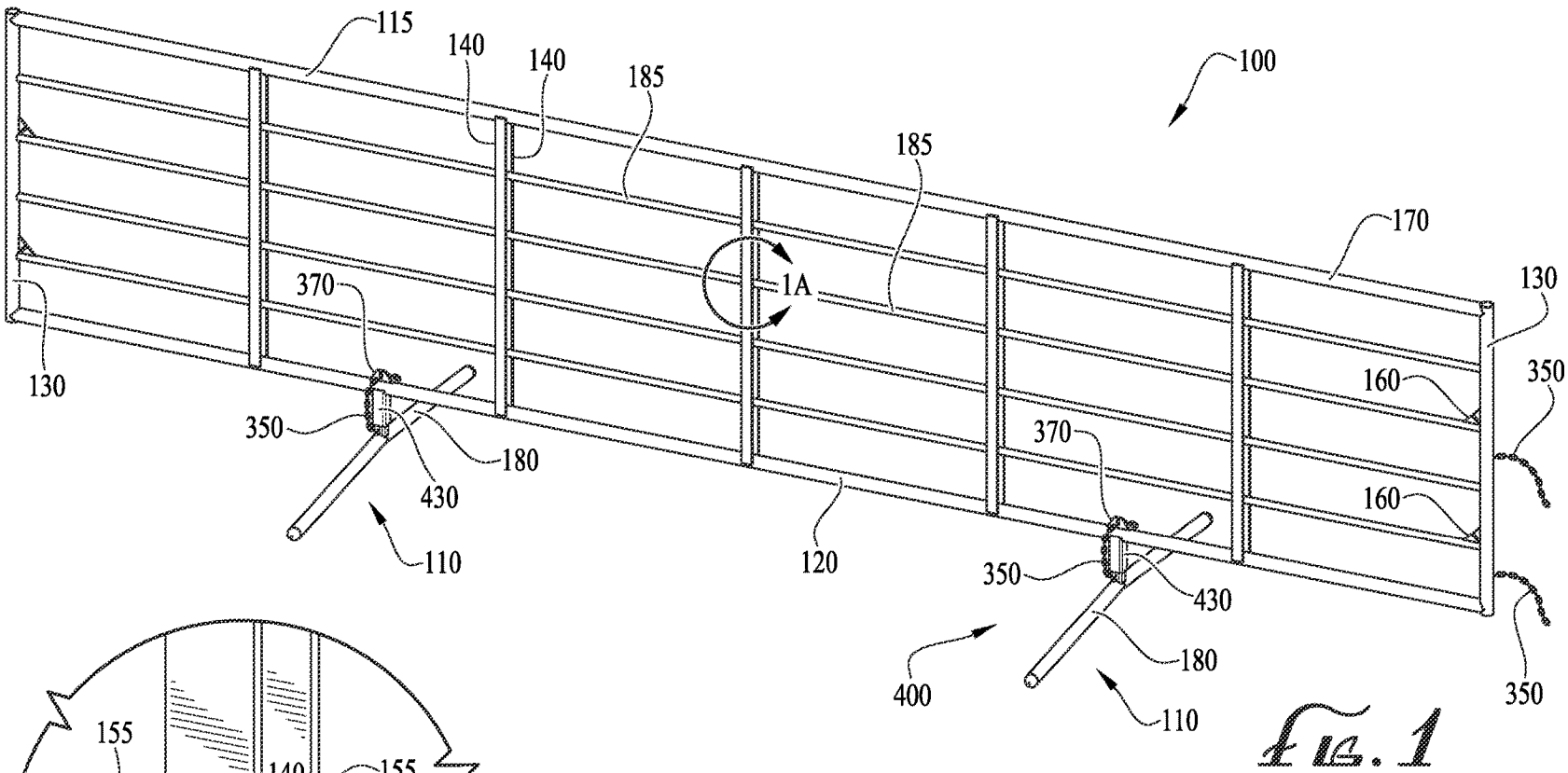
FIG. 1 is a perspective view of a portable corral fence panel of illustrative embodiments in a standing position.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An apparatus, system and method for a portable corral fence panel will now be described. In the following exemplary description, numerous specific details are set forth in order to provide a more thorough understanding of embodiments of the invention. It will be apparent, however, to an artisan of ordinary skill that the disclosed and claimed invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a foldable base unit includes one or more foldable base units.

Illustrative embodiments provide an apparatus, system and method for a portable corral fence panel. While for ease of description and so as not to obscure the invention, illustrative embodiments are described in terms of cattle corrals, nothing herein is intended to limit the invention to that embodiment. The invention may be applied equally to other domestic herd or herd-like animals, such as horses, sheep, goats, llamas, alpacas, pigs, miniature horses, donkeys, mules, or bison, for example. In some embodiments, the apparatus, system and method for a portable corral panel may be of various sizes, such that the panel may be of an appropriate size and strength to be used with other types of livestock or animals, such as fowl, swine, ungulates or other types of animals, It will be clear to the reader that increasing or decreasing the size of the freestanding fence panel while maintaining its configuration and proportions and specific elements are within the description, disclosure and claims of this invention.

Illustrative embodiments include an apparatus, system and method for a portable freestanding corral fence panel. The portable freestanding corral fence panel of illustrative embodiments may have improved stability as a result of one or more of double-welded support uprights and/or bowed leg base units, improved portability due to improved stackability for storage and/or transportation of the fence panels, and/or increased corral security provided by easy connect/disconnect high visibility chain lock tab connections between the panels.

Illustrative embodiments may provide a portable, freestanding fence panel and/or portable freestanding gate panel with adjustable legs. Adjustable base units of illustrative embodiments may be moveable, foldable flat and/or rotatable from a standing position to a stacking position and vice versa. In the stacking position, the portable fence panels and/or portable gate panels with one or more base units folded flat, may provide for flat stacking of several fence panels and/or gate panels together. Thus, illustrative embodiments may store and/or transport more efficiently and with less effort or man hours. As a further improvement, when base unit feet are oriented in the stacking position the feet may conveniently stay attached to the portable fence panels and/or portable gate panels, but do not interfere with stacking and/or hauling the panels. Illustrative embodiments may provide improvements over conventional portable fence panels because illustrative embodiments may use less space when stored and/or transported and therefore may be less expensive and require less man hours to store, ship and/or haul due to these improved stacking features.

In some embodiments, the base units may rotate and/or adjust from a standing position into a stacking position such that the feet of the base unit are parallel to the panel frame in the stacking position. The stacking position may allow fence panel frames and/or gate panel frames to lie flat and/or multiple panel frames to stack one above the other without the leg position impeding the stacking process and may allow the panels to fit together in a compact, flat pile for storage and/or transport. To change a panel frame from a standing position to a stacking position, for example, the base unit may be detached by sliding it out of the panel leg socket, rotating the base unit 90 degrees and sliding it back into the panel leg socket in the stacking position. The leg socket and foot peg may be constructed as a square male/female connection, a round male/female connection, a lock tab and slot connection, a spring-loaded pop-out button connection, a telescoping connection or other connection that provides easy and quick attachment and detachment such that the base unit may change orientation to easily adjust from a standing to a stacking orientation, and once moved into the desired position, securely attached to the fence panel and/or gate panel. Reliable stability to the panel frame and/or gate frame in the standing position, and flush stackability in stacking position may be provided by illustrative embodiments. In some embodiments, the base unit may rotate without detaching, locking into either orientation for stability. In certain embodiments, once adjusted into either the standing position or the stacking position, the fence base unit and/or gate base unit may easily lock into either the stacking and/or standing position using a chain and tab locking mechanism.

FIG. 1 illustrates a portable freestanding corral fence panel of illustrative embodiments. FIG. 1 shows freestanding corral fence panel 100 in a standing position with two base units 110 arranged in standing position 400. In the standing position 400, fence foot 180 of fence base unit 110 is oriented ninety degrees (perpendicular) or about ninety degrees to fence frame 170 and/or fence bottom horizontal rail 120. The number of fence base units 110 appropriate to freestanding corral fence panel 100 may vary. The appropriate number of fence base units 110 may depend on the dimensions of fence panel 100, such as the length, height and/or weight. In some embodiments each fence panel 100 may have two fence base units 110 positioned on each end third of the length of panel 100. Fence panels 100 are "freestanding", since each fence panel 100 with fence base units 110 oriented in standing position 400 (shown in FIG. 4D) may stand on its own without the need to lean against another adjacent fence panel or object. Each fence base unit 110 may have an associated fence leg socket 430 and lock tab 370, as further described herein.

In an exemplary embodiment for cattle, portable freestanding corral fence panel 100 may be about six feet tall, about twelve or twenty-four feet long made of steel piping and weigh about 550 pounds, although the invention is equally applicable to panels of other dimensions. Dimensions of fence panel 100 may be altered to be of larger or smaller sizes, but may generally be square or rectangular, and in many embodiments may be proportional to these illustrative dimensions. While for ease of description the illustrative embodiments tend toward use for corralling cattle, the invention is not so limited.

Fence frame 170 may be constructed of steel pipe, for example. The appropriate size of the steel pipe may be chosen considering the type of livestock to be corralled, the desirable weight of fence panels 100, and storage and transportation concerns. One illustrative embodiment may be of fence frame 170, which may form a rectangle or square and be composed of a bottom horizontal fence rail 120, a top horizontal fence rail 115, and a pair of vertical fence rails 130 to create a strong and stable fence frame 170 for portable corral fence panel 100. In this embodiment bottom horizontal fence rail 120 and/or top horizontal fence rail 115 may be made of 2⅜-inch heavy wall pipe, for example. Vertical fence rails 130 may be made of 1¼ inch round steel pipe or 2⅜-inch heavy wall pipe, for example. The steel pipe may be new or used steel pipe, and may be painted or unpainted. Steel pipe appropriate for illustrative embodiments may be vinyl coated or uncoated. Other materials, such as bars, pipes, posts, tubes and/or beams appropriate to the livestock and fence panel dimensions may also be appropriate for various illustrative embodiments. Internal horizontal rails 185 and uprights 140 may fill the space inside fence frame 170 to prevent livestock from passing through the fence panel 100 and/or providing support and structure to fence panel 100.

Figure 1A:
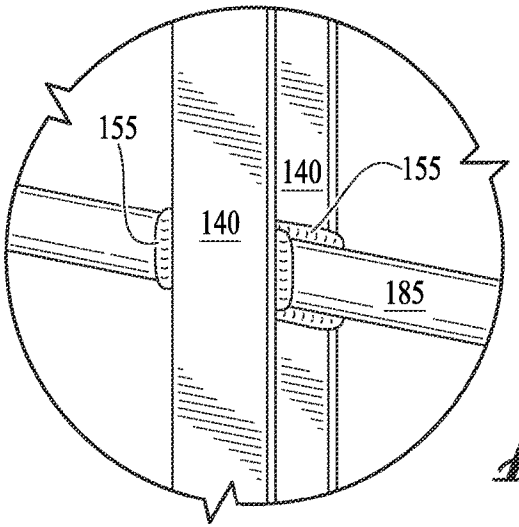
FIG. 1A is an enlarged view of double welded straps of the portable corral fence panel of FIG. 1.

Freestanding livestock fence panels 100, particularly if intended for cattle, horses and similar larger animals, may have a plurality of internal horizontal rails 185, in addition to fence frame 170. As shown in FIG. 1A, interior to fence frame 170, fence panel 100 may be strengthened and supported by a plurality of pairs of straps, tubes and/or flatbar uprights 140 that may be made of 2⅜-inch heavy weld pipe or 2-inch×0.250 flatbar, for example. One upright 140 may be positioned on each of the front and back of internal horizontal rails 185 across from one another to sandwich the internal horizontal rails 185 and/or horizontal portions of fence frame 170. Welds 155 on both the front and back of each internal horizontal rail 185 and/or welds for each upright 140 in a pair may provide double-welded strength. Welds 155 may attach uprights 140 on both the inside and outside (front and back) of horizontal rails 185 across from one another for increased stability and/or prevent bending of the panel frame. For example, double-weld uprights 140 may sandwich internal horizontal rails 185. In some embodiments, uprights 140 may also be welded to bottom horizontal fence rail 120 and top horizontal fence rail 115.

Freestanding corral fence panels 100 may include means to attach one fence panel 100 to an adjacent fence panel and/or gate panel 200 (shown in FIG. 2) such as a chain and tab connection, a lock and chain connection, drop-pin, or a hooked connection. Fence panels 100 may have panel tabs 160 on each end of two of internal horizontal fence panel rails 185 where they meet vertical fence rails 130. Panel tabs 160 and their associated chains 350 may be used to attach one freestanding corral fence panel 100 to another and/or a gate panel 200, to form a system of freestanding corral fence panels as described herein and/or to create the corrals of illustrative embodiments shown in FIG. 8 and FIG. 9, for example.

Fence panel 100 may be one of a plurality of identical fence panels 100 or varying sized fence panels 100 that in combination with one or more gate panels 200 may form a corral or fence system. Attachment mechanisms such as chain 350 and panel tabs 160, for example, may be employed as illustrated herein, or fence panels 100 may attach using drop-pin or other attachment mechanisms. Chain 350 and panel tab 160 locking system provides an advantage in that it can be seen from a distance that fence panels 100 are properly and securely connected and locked in place, which is a disadvantage of drop-pin locking and some other attachment mechanisms. In other embodiments, fence panel 100 may be used to supplement permanently installed fencing to block a damaged permanent fence panel, or may be used to supplement permanently installed fencing to create a squeeze chute, for example, to load livestock into a trailer or for other purposes desired by to users of portable fence panels.

Figure 4A:
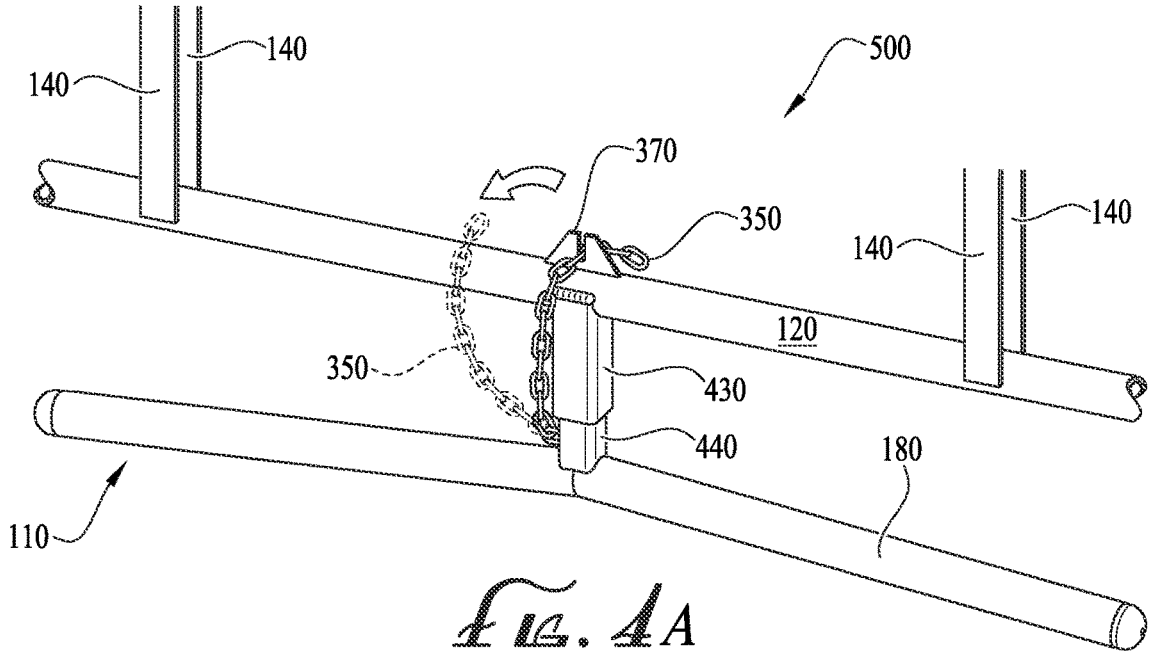
FIG. 4A is a perspective view of a fence base unit of illustrative embodiments in a stacking position and being unlocked.
Figure 4B:
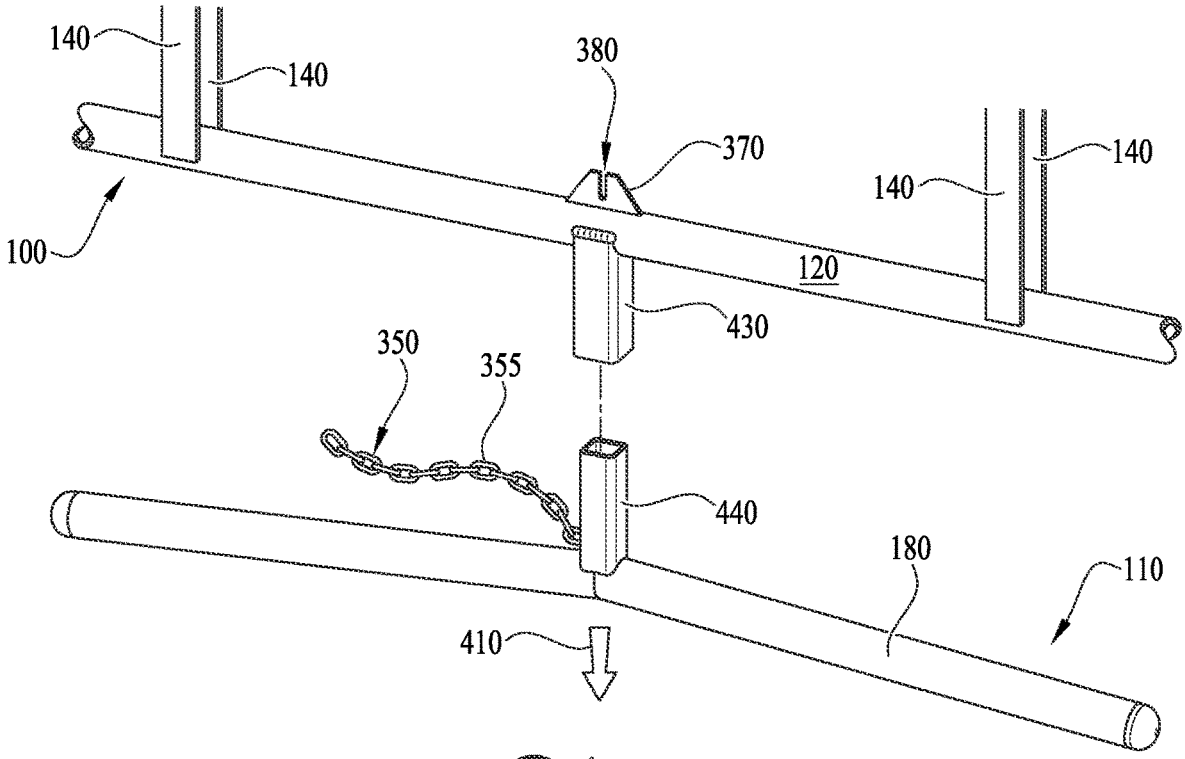
FIG. 4B is a perspective view of a fence base unit of illustrative embodiments being removed from a fence leg socket.
Figures 4C, 4D:
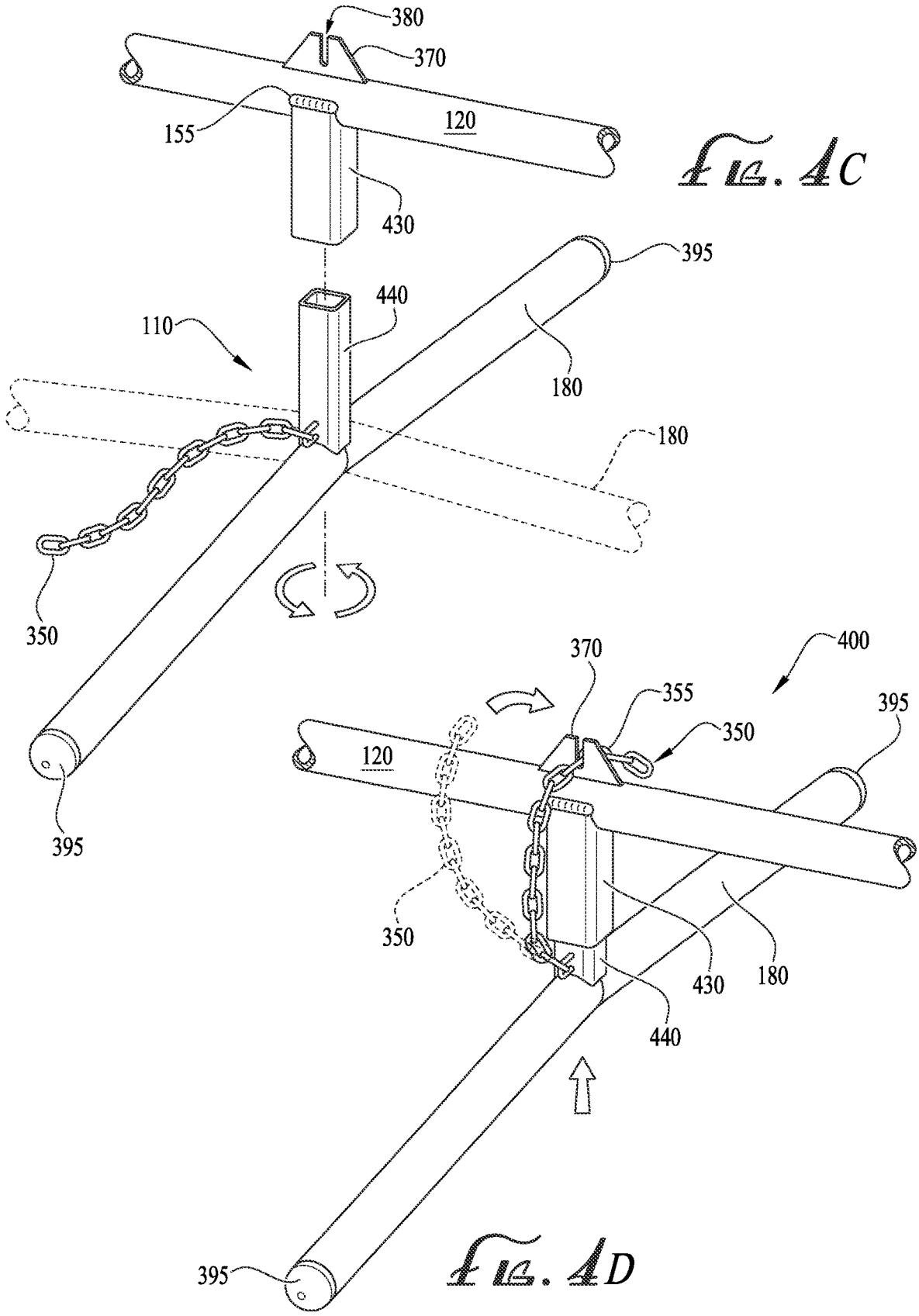
FIG. 4C is a perspective view of a fence base unit of illustrative embodiments being rotated from a stacking position to a standing position.
FIG. 4D is a perspective view of a fence base unit of illustrative embodiments being locked into a standing position.

FIGS. 4A-4D provide detailed illustration of detachable, adjustable, foldable flat and/or rotatable fence base unit 110 of fence panel 100 of illustrative embodiments. Gate base unit 310 (shown in FIG. 2) may operate on substantially the same concepts and principles, unless described otherwise herein. To stand fence panel 100 and/or place fence panel 100 in standing position 400, fence base unit 110's feet 180 may be oriented perpendicular or about perpendicular (i.e., within five degrees of perpendicular) to fence panel 100 and/or perpendicular or about perpendicular to bottom horizontal fence rail 120, as shown in FIG. 1 and FIG. 4D. Lock tab 370 with slot 380 may be welded, secured and/or attached directly to the top side of bottom horizontal fence rail 120, and panel leg socket 430 may be welded, secured and/or attached to the bottom side of bottom horizontal fence panel rail 120, with the opening of panel leg socket 430 facing downwards and/or away from bottom horizontal fence panel rail 120. Panel leg socket 430 may be a squared tube, square pipe and/or may be a tube or pipe having a square cross-section. Lock tab 370 may be generally triangular in shape, generally rectangular in shape and/or may be any shape to guide chain towards slot 380 and allow chain to be secured inside slot 380 without slipping free.

Fence base unit 110 may include fence peg 440, chain 350 and fence foot 180. To connect fence base unit 110 to fence leg socket 430, fence peg 440 may nest, mate and/or slide inside fence leg socket 430. In some embodiments and as shown in FIGS. 4A-4D, fence leg socket 430 may be square in shape to guide fence peg 440 into the correct position and/or for ease of nesting and/or mating. Chain 350 may be attached to fence base unit 110 and/or fence peg 440 with collar 360 (shown in FIG. 3B), and may wrap from fence peg 440 around bottom horizontal fence rail 120 and secure into slot 380, to securely attach fence base unit 110 to fence panel 100 and secure fence base unit 110 in the standing position 400. Fence peg 440 may be hollow or solid and may be welded and/or secured to panel foot 180. In some embodiments, fence peg 440 and leg socket 430 may be pipe with a square cross section, with fence peg 440 having an outer diameter of smaller cross section than the inner diameter of leg socket 430. Fence peg 440 may be sized such that fence peg 440 fits snugly within leg socket 430, but may be easily inserted and removed from leg socket 430 with some applied pressure.

If fence panel 100 has been locked in stacking orientation 500 with fence feet 180 folded flat, as shown in FIG. 4A, then fence base unit 110 may be unlocked from stacking position 400 by removing link 355 of chain 350 from slot 380 of lock tab 370, as shown in FIG. 4A. Fence base unit 110 may be removed from fence leg socket 430, as shown by arrow 410 in FIG. 4B, by sliding fence peg 440 out of fence leg socket 430 and/or unmating fence peg 440 and fence leg socket 430. Fence base unit 110 may then be rotated from parallel to perpendicular to bottom horizontal fence rail 120, as shown in FIG. 4C. Fence base unit 110 may then be reinserted into fence leg socket 430 in standing orientation 400, as illustrated in FIG. 4D. To lock fence base unit 110 in standing orientation 400, link 355 of chain 350 may be inserted into slot 380 as shown in FIG. 4D, preventing base unit 110 from disconnecting or rotating unintentionally. For fence base unit 110, chain 350 may be attached to fence peg 440 using a collar such as collar 360 (shown in FIG. 3B), may be attached by weld 155, or other means. Fence foot 180 may be bowed, arched or flat. Bowing or arching of fence foot 180 may provide stability for fence panel 100 when standing on uneven, sloping, or otherwise less than flat surfaces.

Fence peg 440 may be the male half of fence leg socket 430 such that fence peg 440 inserts inside fence leg socket 430, or the male and female parts may be reversed. Fence peg 440 may be a square tube that slides inside female fence leg socket 430 when fence base unit 110 is being attached to fence frame 170. Square tubing for fence leg socket 430 and fence peg 440 may guide positioning of fence base unit 110 into standing position 400 or stacking position 500. Fence peg 440 may securely fit, nest and/or mate to fence leg socket 430 in both the standing position 400 and the stacking position 500.

Alternatively, fence leg socket 430 and fence peg 440 may slide and/or telescope together and/or apart and/or may fit together with a keying connection, plug-in system or similar. In some embodiments, the male/female relationship may be reversed between fence leg socket 430 and fence peg 440. Those of skill in the art will appreciate that if fence panel 100 has been stacked in a stacking position 500, then a similar method may be employed to remove, rotate and/or reattach fence base unit 110 from stacking position 500 to standing position 400.

Figure 2:
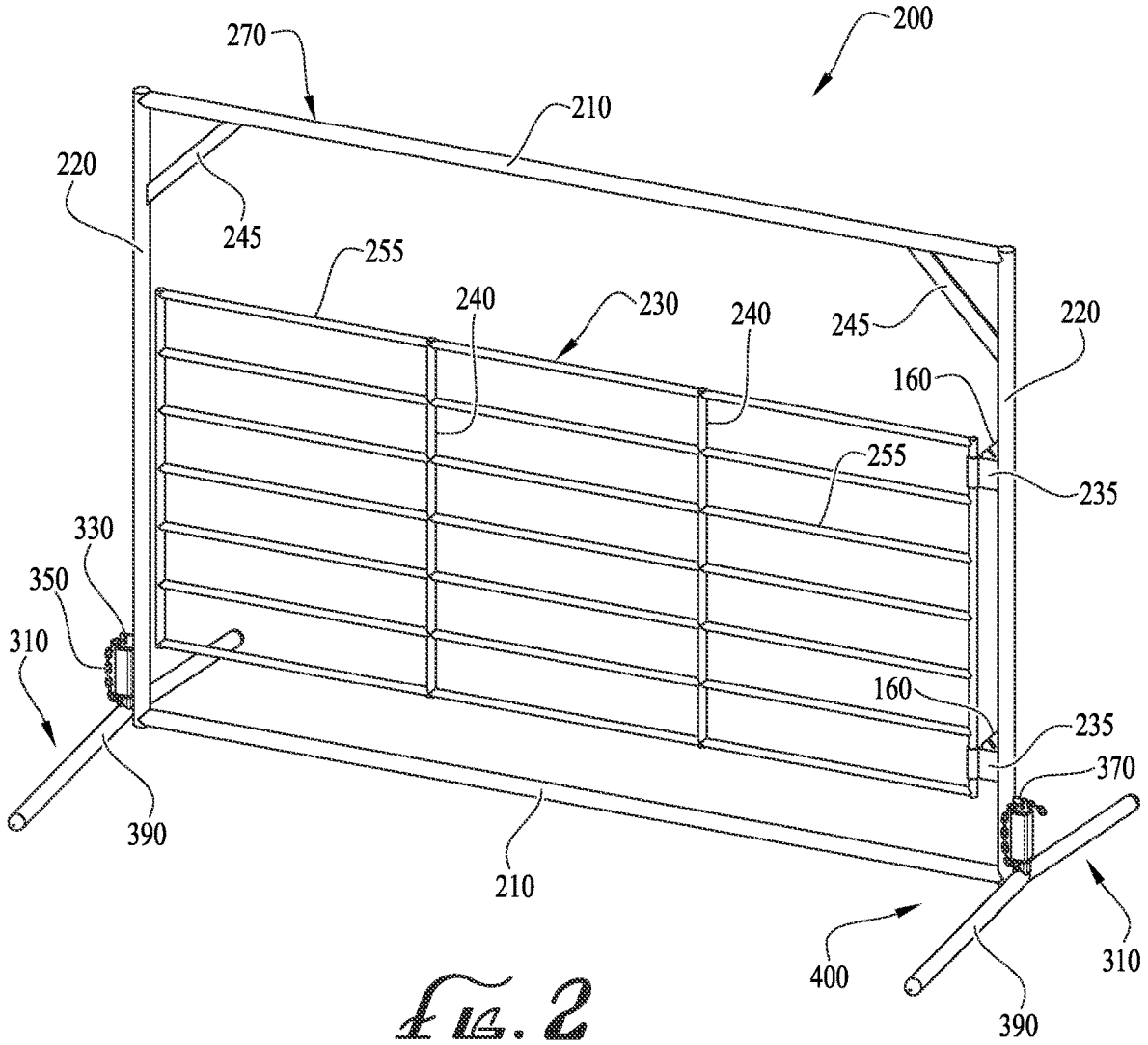
FIG. 2 is a perspective view of a portable corral gate panel of illustrative embodiments in a standing position.

FIG. 2 illustrates an embodiment of portable freestanding corral gate panel 200, which may include a supporting frame, a gate, and two base units. Gate 230 may swing open and closed by hinging about supporting frame 270 on a pair of hinges 235. Supporting frame 270 of portable freestanding corral gate panel 200 may include one or two horizontal gate support rails 210 and two or more vertical posts 220. Horizontal gate support rails 210 and vertical posts 220 may be reinforced with cross braces 245 in one or more embodiments to add strength and structure to the supporting gate frame 270. The gate 230 of gate panel 200 may be made of materials similar to that of freestanding corral fence panel 100, but gate panel 200 may generally be of smaller length than fence panel 100. The length of gate panel 200 may be selected based on a safe and practical dimension for the type of livestock to be corralled. Care must also be taken to determine a dimension that is well supported by the size of supporting frame 270. Hinges 235 may permit gate 230 to swing open and closed on supporting frame 270 and be of any well-known type appropriate to the application but must be selected and welded such that the gate does not sag. Hinges 235 may be selected to provide a 90, 180, or greater range of swing as appropriate for the intended use of gate panel 200. The body of gate 230 may be formed by horizontal gate panel rails 255 and vertical gate panel rails 240. In some embodiments, gate 230 may be reinforced and supported by double-welded uprights 140. Panel tabs 160 of gate panel 200 may be attached to each hinge 235 and may serve to attach gate panel 200 to an adjacent fence panel 100 or an adjacent gate panel 200.

Gate panel 200 may be supported as a freestanding corral gate by two gate base units 310 and/or at least two gate base units 310. When part of gate panel 200, gate base units 310 may be attached to the outer side of each vertical post 220 (the side of vertical post 220 opposite gate 230). An illustrative embodiment of gate base unit 310 is shown in FIGS. 3A-3D. In FIG. 2, gate panel 200 is supported by two gate base units 310 placed at each side and/or end of gate panel 200 on the outside, bottom portion of each vertical post 220 and/or on the opposite side of vertical post 220 as bottom horizontal gate rail 210. Gate base units 310 may be positioned so that gate feet 390 rest on the ground in standing position 400.

Turning to FIGS. 3A-3D, the outer, bottom side of vertical post 220 may include in one or more illustrative embodiments, lock tab 370 with slot 380, gate leg socket 330, and weld 155. Lock tab 370 may be of various shapes to fit supported against its respective rail and/or gate leg socket 330 and allow chain 350 to be guided into slot 380. For example, in FIGS. 4A-4D, lock tab 370 is approximately triangular in shape with slot 380 placed centrally. In FIGS. 3A-3D, lock tab 370 is somewhat rectangular, but with rounded portions. Gate leg socket 330 may be a square, hexagonal, stepped collar or other type of socket. Chain tab 370 may be secured above and/or on the top of gate leg socket 330. Chain tab 370 may be supported on a bottom side by gate leg socket 330 and on the left or right side by vertical post 220. The opening of gate leg socket 330 may face downwards away from lock tab 370. Gate leg socket 330 may be welded to vertical post 220 at a height such that gate foot 390 rests on the ground when gate base unit 310 is inserted in standing position 400.

Gate base unit 310 may mate to gate leg socket 330 with gate peg 340 and be easily and securely attached in at least two distinct orientations and/or detached. The embodiment illustrated in FIGS. 3A-3D is of a simple pair of nesting squares. Gate base unit 310 may have chain 350 attached by collar 360, welded, hooked or similar type of attachment, or chain 350 may alternatively be attached to gate leg socket 330 or vertical post 220 and/or the outer diameter of gate leg socket 330 or vertical post 220. Gate peg 340 may be welded, secured and/or attached to feet 390 in one or more embodiments. Gate feet 390 may be flat, bowed, arched or other shape appropriate to the intended use of the freestanding corral fence panel system. Bowed or arched gate feet 390 may provide increased stability on uneven, sloping, or otherwise less than flat surfaces. Where gate feet 390 and/or fence feet 190 are made of pipe or tubing, the ends of gate feet 390 and/or fence feet 190 may be closed by caps 395 to prevent dirt and other debris from entering the tubing of feet 190, 390.

Gate peg 340 may be the male half of the base unit 310 such that gate peg 340 inserts inside gate leg socket 330, or vice versa. Gate peg 340 may be a square tube that slides inside female gate leg socket 330 when base unit 310 is being attached to gate supporting frame 270. Square tubing for gate leg socket 330 and gate peg 340 may guide positioning of gate base unit 310 into standing position 400 or stacking position 500. Alternatively, gate leg socket 330 and gate peg 340 may slide and/or telescope together and/or apart and/or may fit together with a keying connection, plug-in system or similar. In some embodiments, the male/female relationship may be reversed between gate leg socket 330 and gate peg 340. Fence base unit 110 may also be so reversed.

Figure 3A:
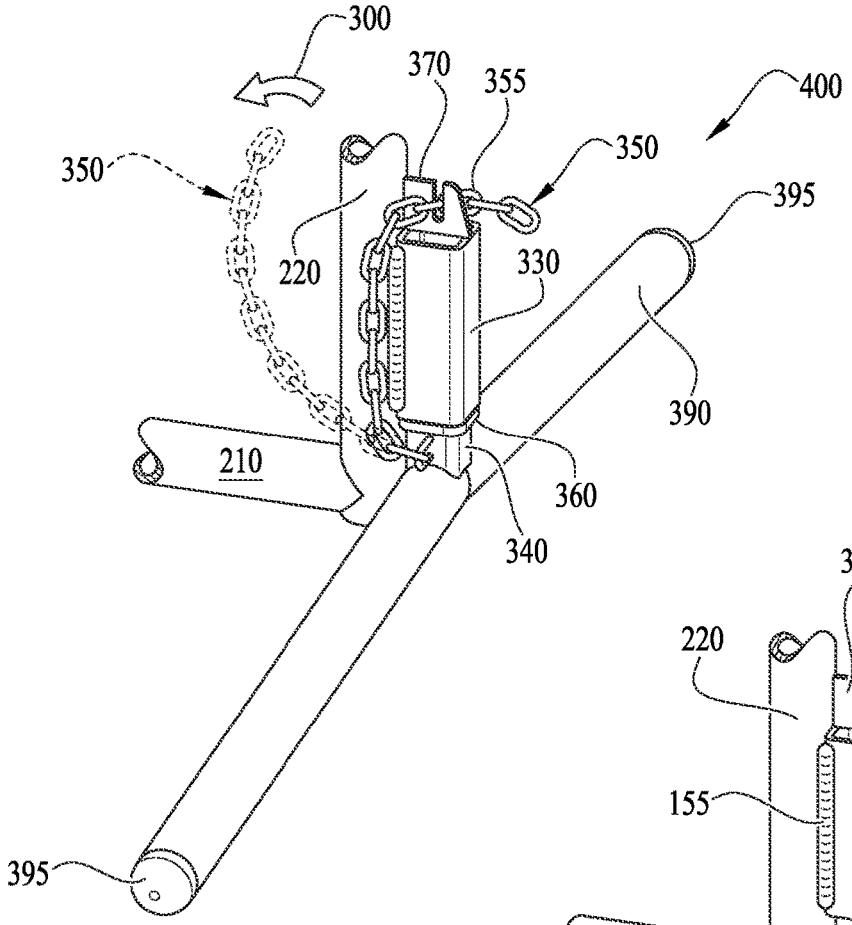
FIG. 3A is a perspective view of a gate base unit of illustrative embodiments in a standing position and being unlocked.
Figure 3B:
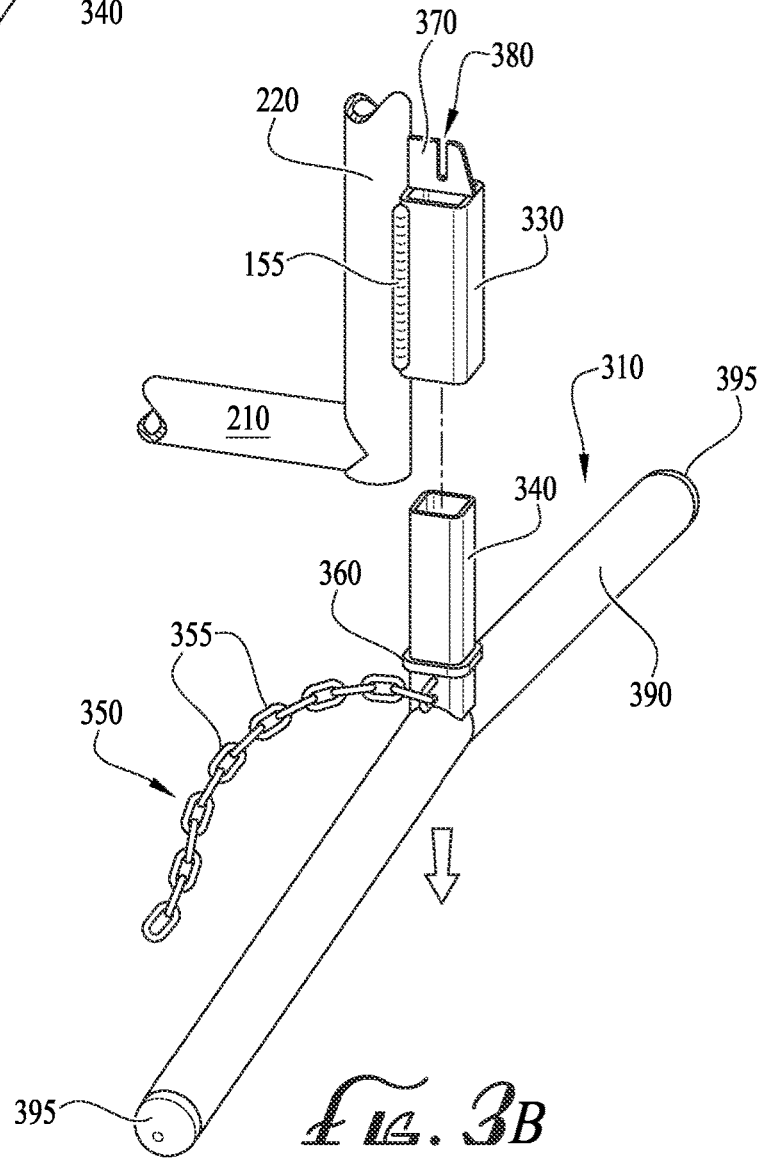
FIG. 3B is a perspective view of a gate base unit of illustrative embodiments being removed from a gate leg socket.
Figure 3C:
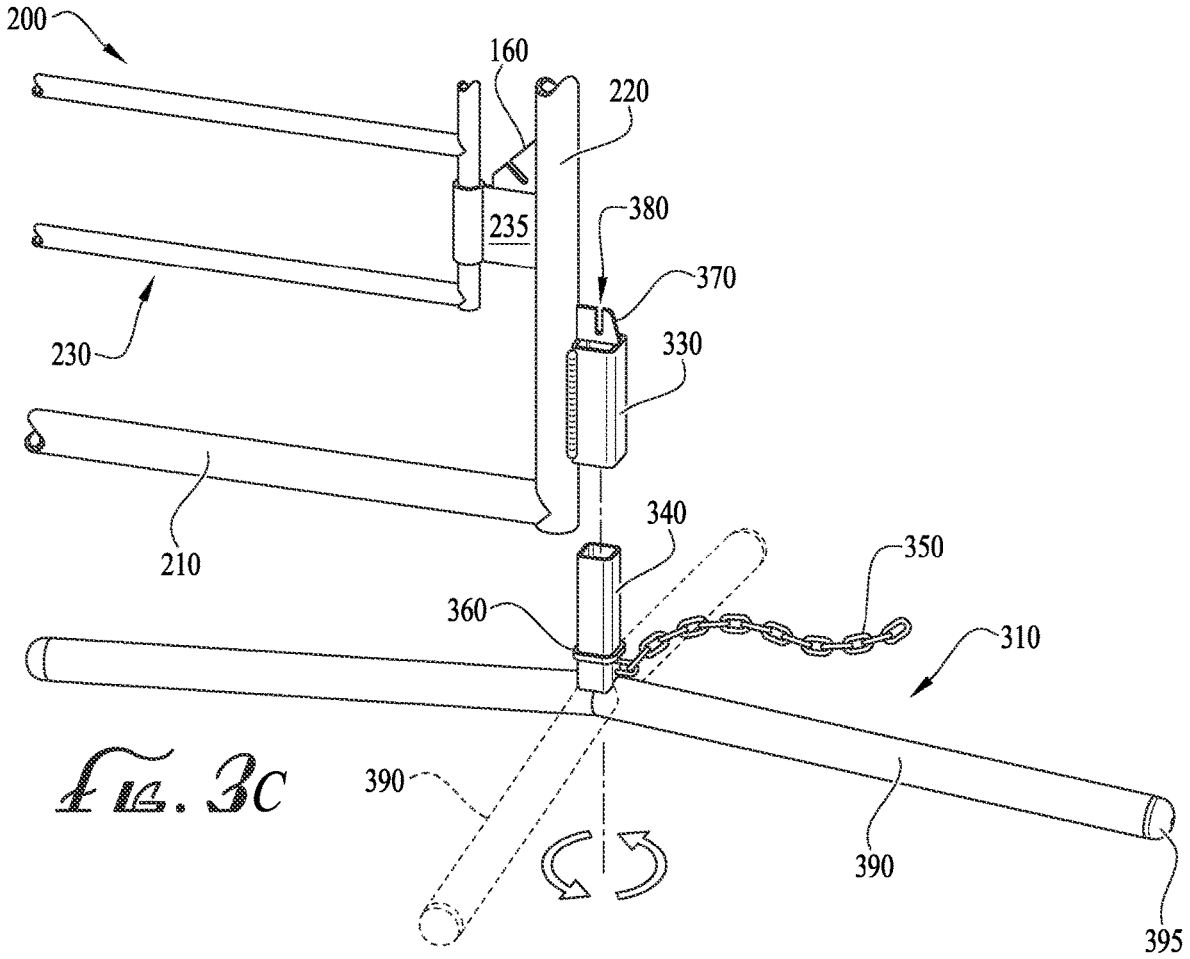
FIG. 3C is a perspective view of a gate base unit of illustrative embodiments being rotated from a standing position to a stacking position.
Figure 3D:
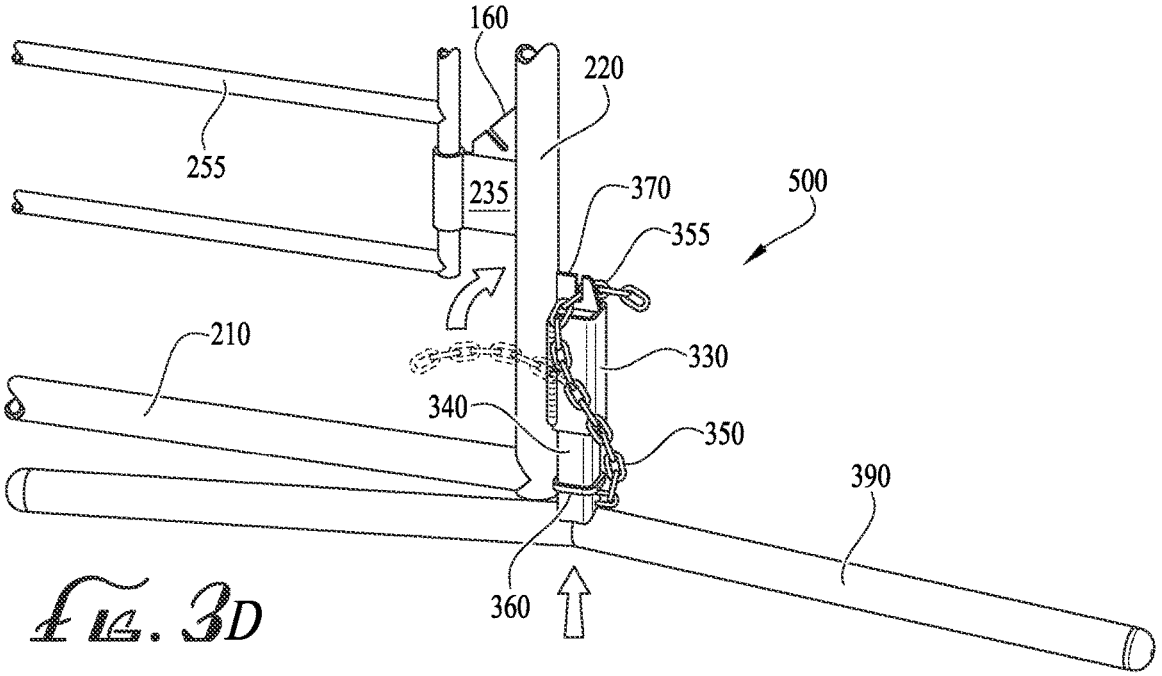
FIG. 3D is a perspective view of a gate base unit of illustrative embodiments being locked into a stacking position.

FIG. 3A illustrates gate base unit 310 attached to gate panel 200 in standing position 400. In FIG. 3A gate base unit 310 is locked into place and arrow 300 shows chain 350 being unlocked from lock tab 370. To unlock lock tab 370, link 355 of chain may be removed from slot 380 of lock tab 370. In FIG. 3B, gate base unit 310 is being removed from gate leg socket 330. In FIG. 3C, gate base unit 310 is being rotated to fold flat into stacking position 500. In FIG. 3D, gate base unit 310 is attached and locked in stacking position 500, such that gate feet 390 fold flat and/or are parallel to gate supporting frame 270 and/or gate bottom rail 210. To lock into place, chain 350 may wrap around gate leg socket 330 and a link 355 of chain 350 may catch inside slot 380 of lock tab 370.

In certain embodiments, fence base unit 110 and/or gate base unit 310 may rotate without the need for disconnecting. For example, gate leg socket 330 may slide down gate peg 340 to provide a clearance, rotated about gate peg 340 and then reattached in the rotated position. In this example, the diameter of gate peg 340 may taper to allow rotation without disconnection and/or gate leg socket 330 and/or gate peg 340 may be round pipe to permit connected rotation. In some embodiments, gate leg socket 330 and gate peg 340 may be magnetized and may use or not use a chain tab locking system. In certain embodiments, chain 350 and lock tab 370 may be replaced by a flexible o-ring, c-clamp or removable pin that removeably holds gate leg socket 330 and gate peg 340 in place. Fence base unit 110 and/or fence leg socket 430 may also be so modified.

Figure 5:
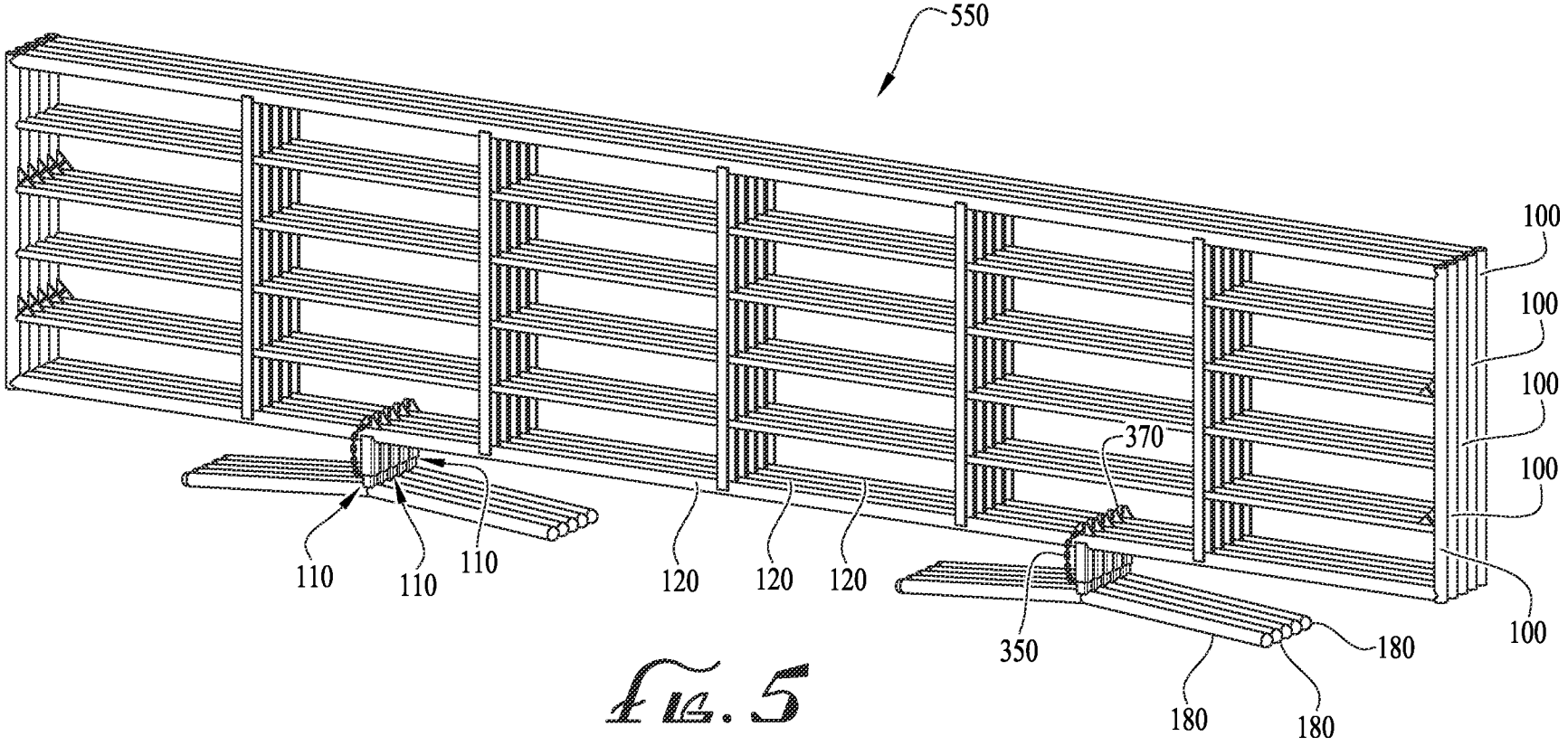
FIG. 5 is a perspective view of a stack of fence panels including folded and locked fence base units of illustrative embodiments.
Figure 6:
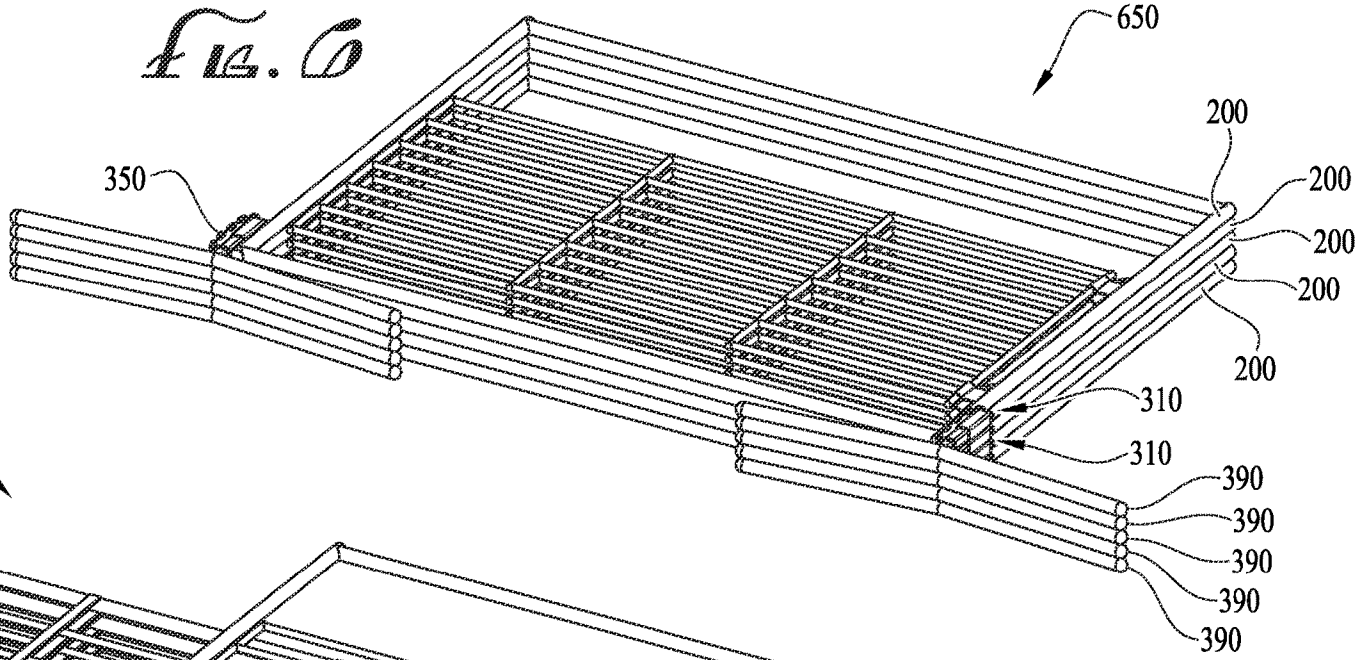
FIG. 6 is perspective view of a stack of gate panels including folded and locked gate base units of illustrative embodiments.
Figure 7:
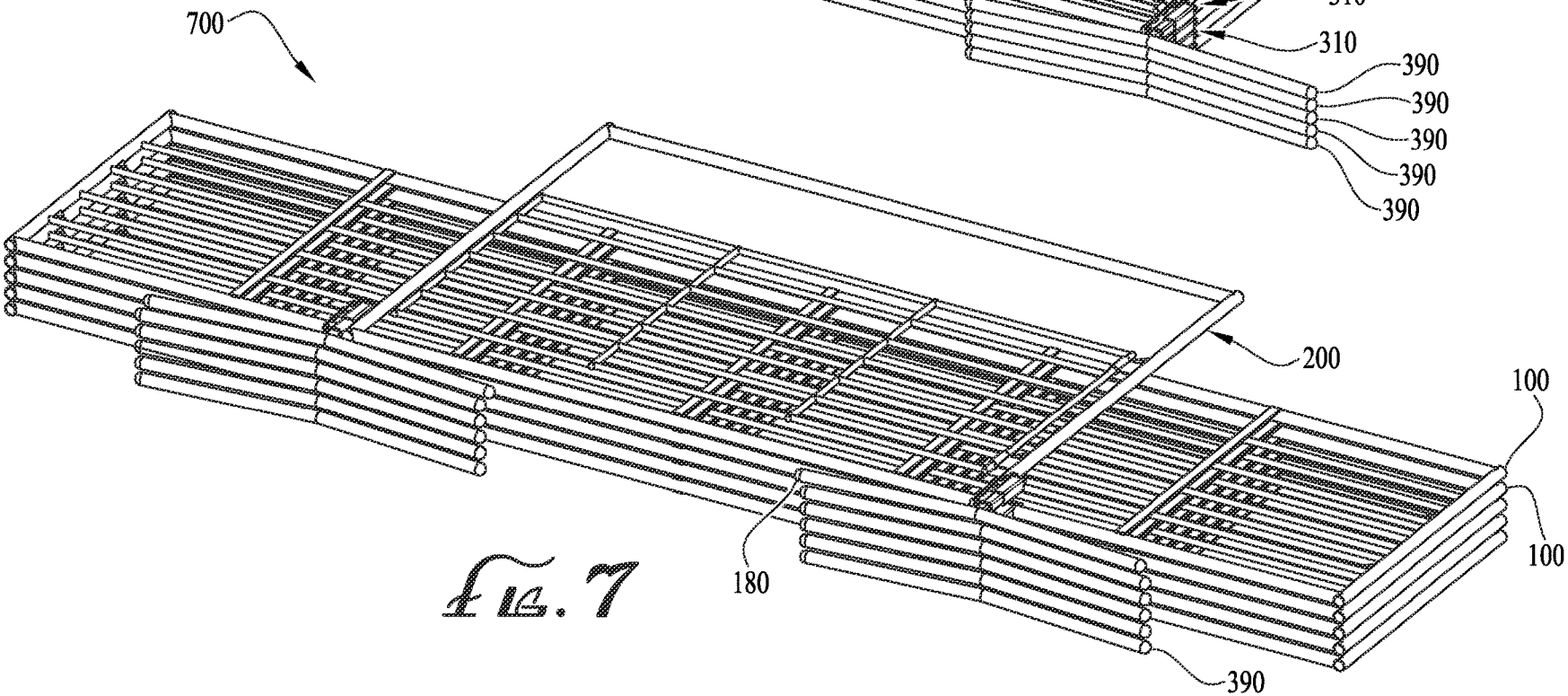
FIG. 7 is perspective view of a stack of folded fence panels and gate panel of illustrative embodiments.

FIG. 5 illustrates a plurality of fence panels 100, each with associated fence base unit 110 attached and locked to fence panel 100 in a stacking position 500, with fence feet 180 folded flat. As shown in FIG. 5, feet 180 are parallel or about parallel to bottom horizontal rail 120 of fence panel 100. In this manner, fence panels 100 stack together in a neat, space-saving fence stack 550 with folded flat fence feet 180 and a plurality of fence panels 100 may be stored and/or transported. FIG. 6 similarly shows gate panels 200, each with associated gate base units 310 attached and locked to gate panel 200 in a stacking position 500. Similarly, in this manner, gate panels 200 may stack together in a neat, space-saving gate stack 650 with folded flat gate feet 390. FIG. 7 illustrates a combined stack 700 of fence panels 100 with a gate panel 200, both fence panel 100 and gate panel 200 folded flat to stack for storage or transport.

FIGS. 5-7 show illustrative embodiments where a plurality of fence panels 100 and/or gate panels 200 with their associated base units 110, 310 all in stacking position 500 may be desirable when fence panels 100 and/or gate panels 200 are lying on their sides with the panels stacked one above the other, for example for storage and/or transportation. Each fence panel 100 may include one or more, or two or more fence base units 110 that rotate, unfold and/or detach to move from stacking position 500 to a standing position orientation 400, and vice versa. Each gate panel 200 may include two or more gate base units 310 that rotates, unfolds and/or detaches to move from stacking position 500 to a standing position orientation 400, and vice versa. Fence stacks 550 of fence panels 100 and/or gate stacks 650 of gate panels 200 may most often be moved using tractors, trailers, forklifts or other devices, for example. In some embodiments, fence panels 100 and gate units 200 may be stacked together in same combined stack 750.

Figure 9:
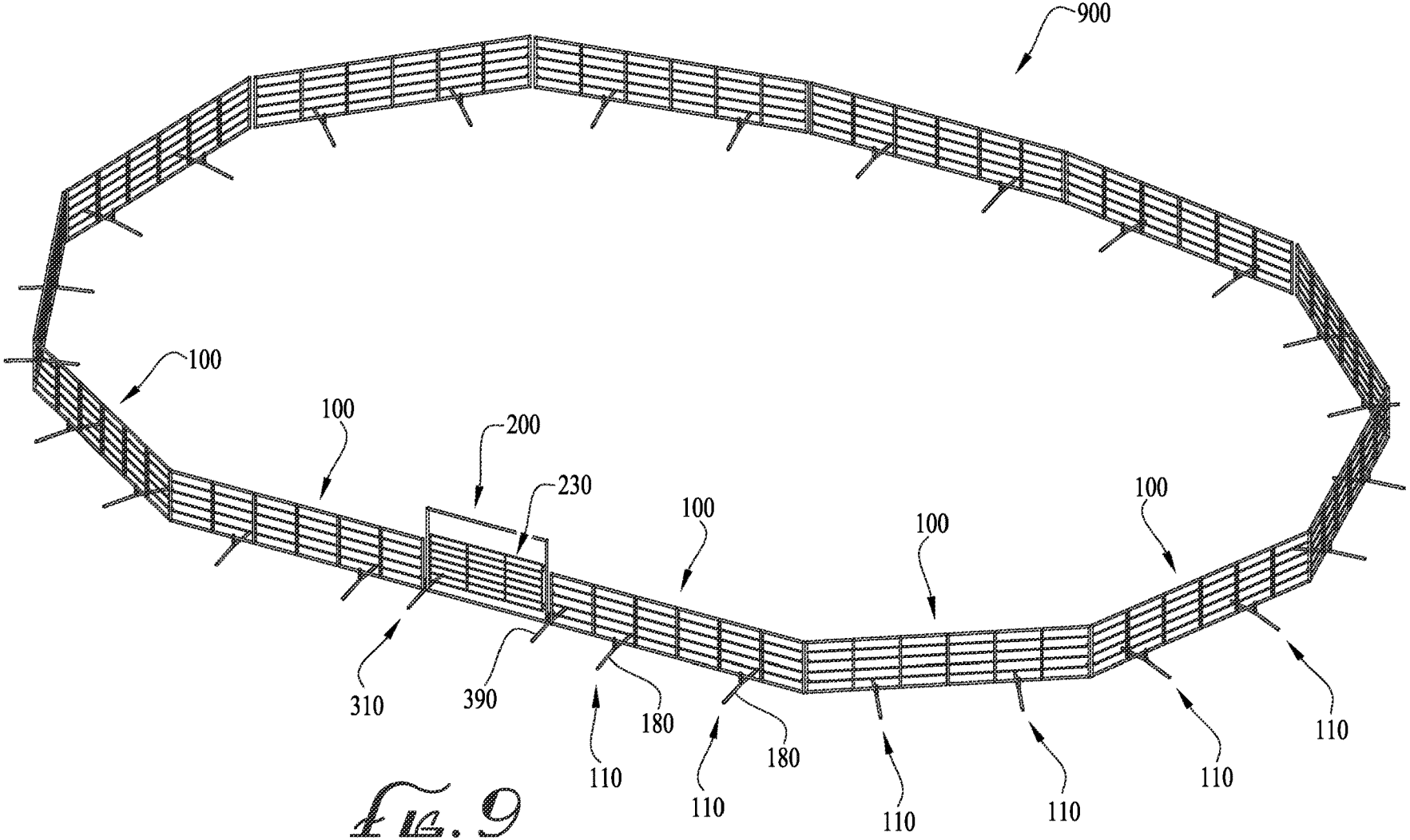
FIG. 9 is perspective view of a round corral created with the portable corral fence panels and a portable corral gate unit of illustrative embodiments.

FIG. 9 illustrates round pen corral system 900 constructed with multiple fence panels 100 and one gate panel 200 of illustrative embodiments. Once transported in stacking position 500 and then adjusted into standing position 400, fence panels 100 and gate panels 200 may be combined in any quantity and in a variety of formations to form a corral of a desired dimension appropriate for the location, type of stock, terrain, function and other considered user requirements. The corral system 900 may be transported to and erected at any suitable location for the livestock.

Figure 8:
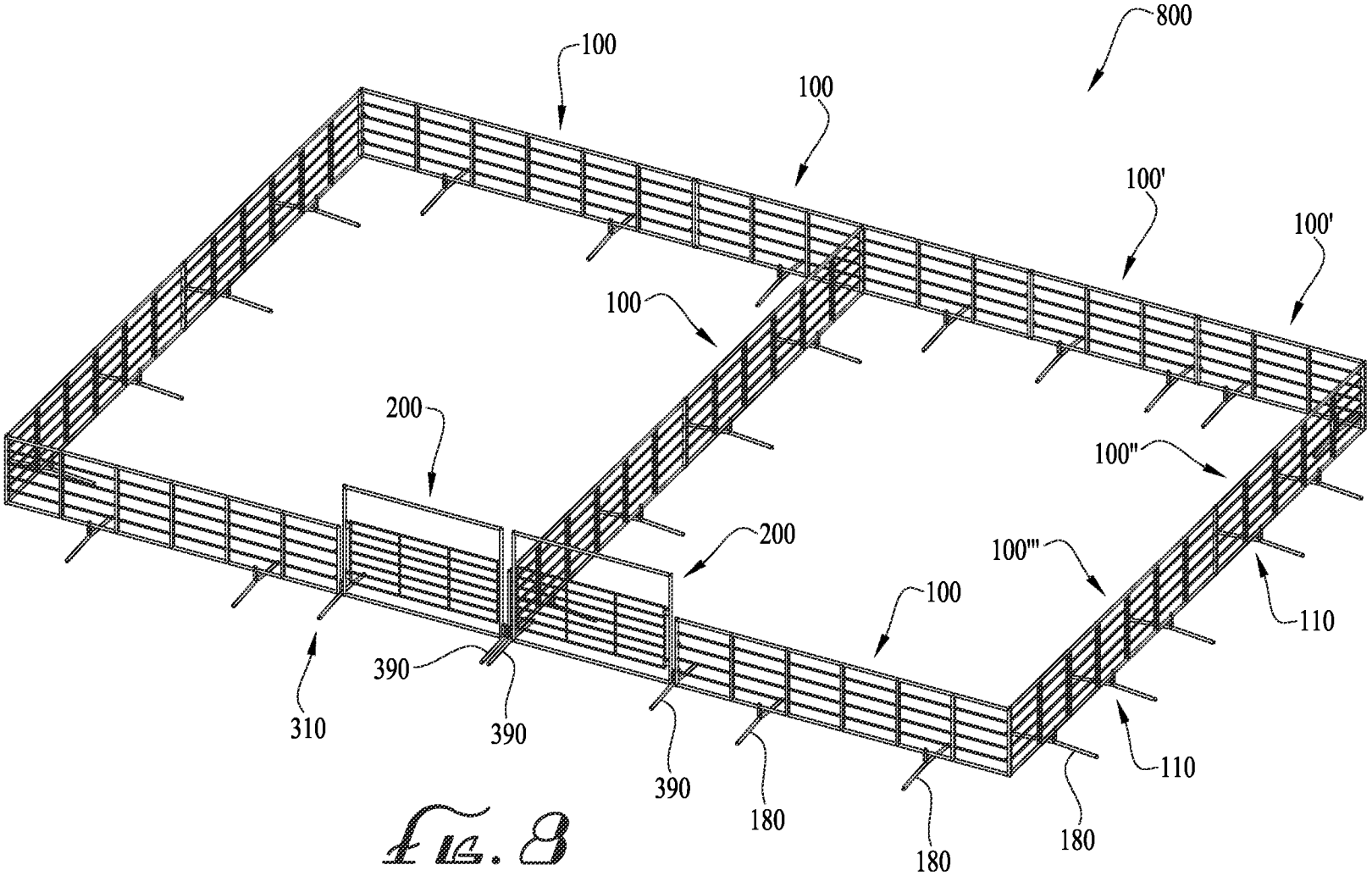
FIG. 8 is perspective view of a catch pen including a plurality of fence panels and two gate panels of illustrative embodiments.

FIG. 8 illustrates catch pen 800 with two gate units 200 and three different dimensioned fence panels 100 of illustrative embodiments. In the example of FIG. 8, fence panel 100' is half the length of fence panel 100, each having two fence base units 110. Fence panel 100''' is longer than fence panel 100, with fence panel 100''' having three fence base units 110 spaced along its length. Fence panel 100" is slightly longer than fence panel 100. FIG. 8 also illustrates two adjacent gate panels 200. FIG. 8 illustrates an example of how systems of various embodiments of the invention may be used together to form any desired size, shape and/or configuration of corral.

Illustrative embodiments may provide improved free-standing gate panels and fence panels, which may include adjustable feet that provides more efficient stackability for ease of travel. The adjustable feet may be rotatable such that the feet turn parallel to the gate panel or fence panel to provide a space-saving feature for stacking for travel. The base units may include a chain and tab locking feature that may secure the feet in two alternative positions: a stacking orientation and a standing orientation. The chain and tab locking system may prevent the base units from undesireably moving out of the desired position/orientation. Panels may include double-welded uprights for strength and durability during travel, stacking and usage in a livestock corral, which may withstand leaning, kicking and the like treatment from livestock.

An apparatus, system and method for a portable corral panel has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A portable livestock corral fence panel comprising:

a horizontal rail comprising a lock tab, the lock tab having a slot and coupled to a top side of the horizontal rail; and an adjustable base unit comprising:

means for mating the adjustable base unit to the horizontal rail opposite to the lock tab;

a foot coupled to the means for mating the adjustable base unit to the horizontal rail; and a chain;

the adjustable base unit mateable to the horizontal rail in two distinct positions:

a standing position, wherein the foot extends perpendicularly to the horizontal rail enabling the fence panel to be freestanding in the standing position; and a stacking position, wherein the foot adjusts parallel to the bottom horizontal rail in the stacking position; and wherein the chain wraps around the horizontal rail and engages the slot to lock the adjustable base unit into either one of the two distinct positions.

2. The portable livestock corral fence panel of claim 1, further comprising a second portable livestock corral fence panel, wherein the stacking position further comprises the first fence panel stacked flat above the second fence panel.

3. The portable livestock corral fence panel of claim 1, wherein the chain further comprises a link, the link engaging the slot to lock the adjustable base unit in one of the two distinct positions.

4. The portable livestock corral fence panel of claim 1, wherein the portable livestock corral fence panel further comprises at least one second horizontal rail, and a pair of vertical straps welded to and sandwiching the at least one second horizontal rail.

5. The portable livestock corral panel of claim 1, wherein the means for mating the adjustable base unit to the horizontal rail comprises a square tube and a peg that nests inside the square tube when mated in either one of the two distinct positions.

6. The portable livestock corral fence panel of claim 5, wherein the foot is rotated ninety degrees between the standing position and the stacking position.

7. The portable livestock corral fence panel of claim 1, wherein the foot is bowed.

8. The portable livestock corral fence panel of claim 1, wherein the portable livestock corral fence panel has exactly two adjustable base units that divide the fence panel into thirds.

9. The portable livestock corral fence panel of claim 1, wherein the adjustable base unit is configured to detach from the horizontal rail to adjustably mate between the standing position and the stacking position.

10. The portable livestock corral fence panel of claim 1, wherein the adjustable base unit is configured to rotate without detaching from the horizontal rail to adjustably mate between the standing position and the stacking position.

11. A portable livestock corral gate panel comprising:

a gate hingedly coupled to a vertical post such that the gate swings around the vertical post;

a horizontal rail extending from the vertical post below the gate;

the vertical post comprising:

an outer side opposite the gate; and a lock tab coupled to the outer side and having a slot;

an adjustable base unit comprising:

means for coupling the adjustable base unit to the outer side; and a foot coupled to the means for coupling the moveable base unit to the outer side; and a chain;

the adjustable base unit mateable to the vertical post in two distinct positions:

a standing position, wherein the foot extends perpendicularly to the horizontal rail enabling the gate panel to be freestanding in the standing position; and a stacking position, wherein the foot adjusts parallel to the horizontal rail in the stacking position; and wherein the chain wraps around the means for coupling the adjustable base and engages the slot to lock the adjustable base unit into either one of the two distinct positions.

12. The portable livestock corral gate panel of claim 11, further comprising the chain coupled to the adjustable base unit by a collar.

13. The portable livestock corral gate panel of claim 11, wherein the means for coupling the adjustable base unit to the outer side comprises a square tube, and the stacking position is rotated ninety degrees From the standing position.

14. The portable livestock corral gate panel of claim 11, wherein means for coupling the adjustable base unit to the outer side comprises a socket configured to mate with a peg in both the standing position and the stacking position.

15. The portable livestock corral gate panel of claim 11, wherein a hinge couples the gate to the vertical post, and further comprising a second lock tab secured in a corner formed by a top of the hinge and an inside of the vertical post.

16. The portable livestock corral gate panel of claim 15, wherein a second chain and the second lock tab are configured to couple a fence panel to the vertical post.

17. The portable livestock corral gate panel of claim 11, wherein the chain further comprises a link, the link engaging the slot to lock the adjustable base unit.

18. The portable livestock corral gate panel of claim 11, wherein the foot is bowed.

19. The portable livestock corral fence panel of claim 11, wherein the adjustable base unit is configured to detach from the outer side to adjustably mate between the standing position and the stacking position.

20. The portable livestock corral fence panel of claim 11, wherein the adjustable base unit is configured to rotate without detaching from the outer side to adjustably mate between the standing position and the stacking position.

* * * * *